US006652067B2

(12) United States Patent
Otsuki

(10) Patent No.: US 6,652,067 B2
(45) Date of Patent: Nov. 25, 2003

(54) PRINTING WITH VARIED TYPES OF INK DOTS

(75) Inventor: Koichi Otsuki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/180,671

(22) Filed: Jun. 25, 2002

(65) Prior Publication Data

US 2003/0025751 A1 Feb. 6, 2003

(30) Foreign Application Priority Data

Jun. 27, 2001 (JP) ..... 2001-194013

(51) Int. Cl.[7] ..... B41J 2/15; B41B 15/00

(52) U.S. Cl. ..... 347/41; 347/15; 347/43; 358/1.8; 358/1.9; 358/517

(58) Field of Search ..... 347/41, 15, 43; 358/1.8, 1.9, 517, 535, 536, 534

(56) References Cited

U.S. PATENT DOCUMENTS 3,977,007 A * 8/1976 Berry et al. ..... 347/15
4,198,642 A 4/1980 Gamblin
4,714,964 A * 12/1987 Sasaki ..... 358/3.1

FOREIGN PATENT DOCUMENTS

JP 11-020165 1/1999

OTHER PUBLICATIONS

Abstract of Japanese Patent Pub. No. 11–020165, Pub. Date: Jan. 26, 1999, Patent Abstracts of Japan.

* cited by examiner

*Primary Examiner*—Lamson Nguyen
(74) *Attorney, Agent, or Firm*—Martine & Penilla, LLP

(57) ABSTRACT

A printing apparatus capable of selectively forming any of N types of dots which are different in at least one of an ink amount and a dot-formed position in a pixel area on a print medium. The printing apparatus comprises a drive signal generator. The drive signal generator is configured to generate drive signals for driving the ejection drive elements to form one of the N types of dots in each pixel area in response to a print signal including two types of mask selection data for selecting one type of masking signal from a plurality of type of masking signals corresponding to the N types of dots.

18 Claims, 11 Drawing Sheets

Drive Signals Generated with First Mask Pattern
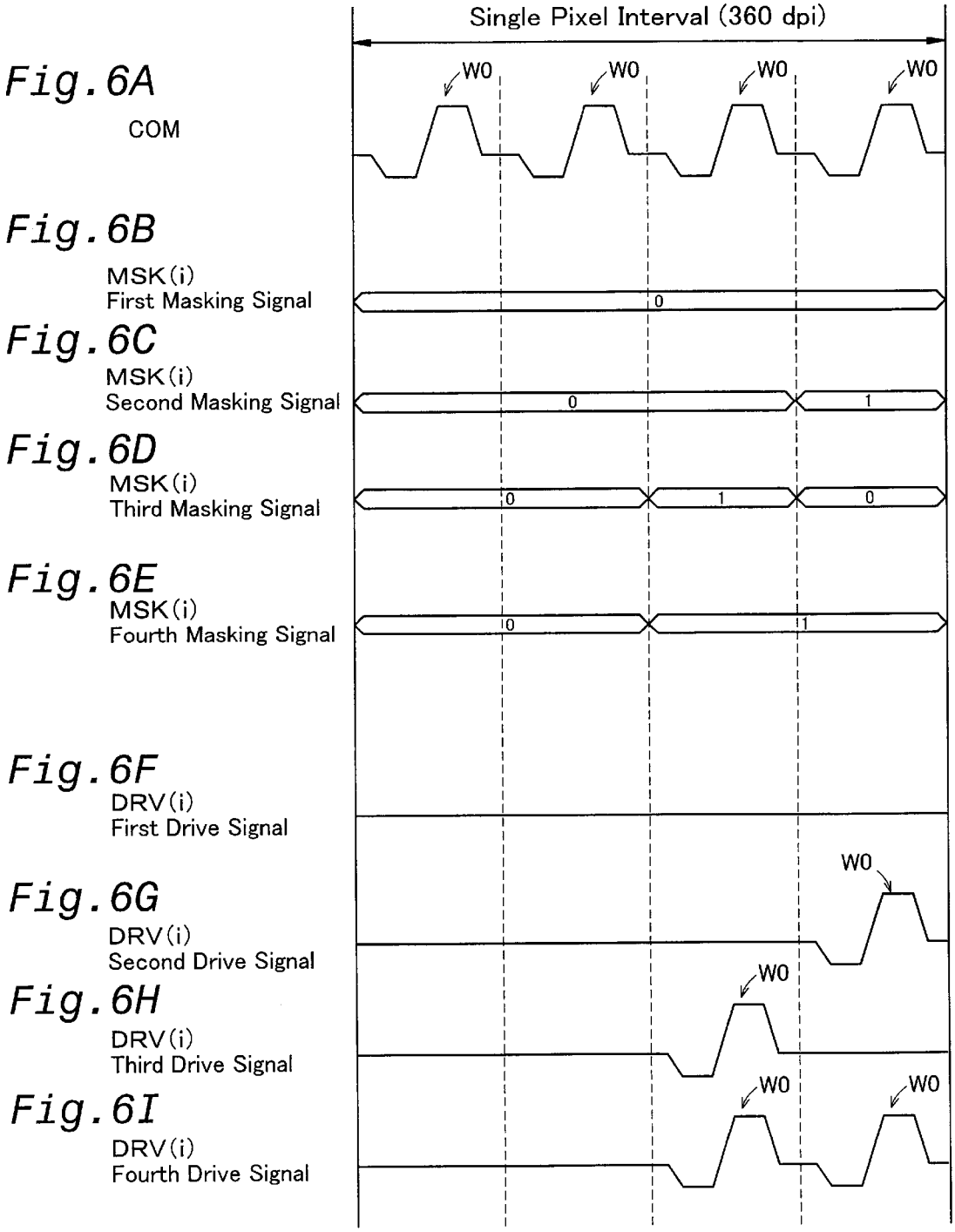

*Fig. 7A*

Truth Table for First Mask Pattern

| DH | DL | V3 | V2 | V1 | V0 | /Q3 | /Q2 | /Q1 | /Q0 | MSK | Cell |
|---|---|---|---|---|---|---|---|---|---|---|---|
| 0 | 0 | 0 | 0 | 0 | 0 | 0 | 0 | 0 | 0 | 0 | T21 |
| | | 0 | 0 | 0 | 0 | 0 | 0 | 0 | 0 | 0 | T22 |
| | | 1 | 1 | 0 | 0 | 0 | 0 | 0 | 0 | 0 | T23 |
| | | 1 | 0 | 1 | 0 | 0 | 0 | 0 | 0 | 0 | T24 |
| 0 | 1 | 0 | 0 | 0 | 0 | 0 | 0 | 0 | 0 | 0 | T21 |
| | | 0 | 0 | 0 | 0 | 0 | 0 | 0 | 0 | 0 | T22 |
| | | 1 | 1 | 0 | 0 | 0 | 0 | 0 | 0 | 0 | T23 |
| | | 1 | 0 | 1 | 0 | 0 | 0 | 1 | 0 | 1 | T24 |
| 1 | 0 | 0 | 0 | 0 | 0 | 0 | 0 | 0 | 0 | 0 | T21 |
| | | 0 | 0 | 0 | 0 | 0 | 0 | 0 | 0 | 0 | T22 |
| | | 1 | 1 | 0 | 0 | 0 | 1 | 0 | 0 | 1 | T23 |
| | | 1 | 0 | 1 | 0 | 0 | 0 | 0 | 0 | 0 | T24 |
| 1 | 1 | 0 | 0 | 0 | 0 | 0 | 0 | 0 | 0 | 0 | T21 |
| | | 0 | 0 | 0 | 0 | 0 | 0 | 0 | 0 | 0 | T22 |
| | | 1 | 1 | 0 | 0 | 1 | 0 | 0 | 0 | 1 | T23 |
| | | 1 | 0 | 1 | 0 | 1 | 0 | 0 | 0 | 1 | T24 |

*Fig. 7B*

Truth Table for Second Mask Pattern

| DH | DL | V3 | V2 | V1 | V0 | /Q3 | /Q2 | /Q1 | /Q0 | MSK | Cell |
|---|---|---|---|---|---|---|---|---|---|---|---|
| 0 | 0 | 0 | 0 | 0 | 0 | 0 | 0 | 0 | 0 | 0 | T21 |
| | | 1 | 1 | 1 | 1 | 0 | 0 | 0 | 1 | 1 | T22 |
| | | 1 | 1 | 0 | 0 | 0 | 0 | 0 | 0 | 0 | T23 |
| | | 1 | 0 | 1 | 0 | 0 | 0 | 0 | 0 | 0 | T24 |
| 0 | 1 | 0 | 0 | 0 | 0 | 0 | 0 | 0 | 0 | 0 | T21 |
| | | 1 | 1 | 1 | 1 | 0 | 0 | 1 | 0 | 1 | T22 |
| | | 1 | 1 | 0 | 0 | 0 | 0 | 0 | 0 | 0 | T23 |
| | | 1 | 0 | 1 | 0 | 0 | 0 | 1 | 0 | 1 | T24 |
| 1 | 0 | 0 | 0 | 0 | 0 | 0 | 0 | 0 | 0 | 0 | T21 |
| | | 1 | 1 | 1 | 1 | 0 | 1 | 0 | 0 | 1 | T22 |
| | | 1 | 1 | 0 | 0 | 0 | 1 | 0 | 0 | 1 | T23 |
| | | 1 | 0 | 1 | 0 | 0 | 0 | 0 | 0 | 0 | T24 |
| 1 | 1 | 0 | 0 | 0 | 0 | 0 | 0 | 0 | 0 | 0 | T21 |
| | | 1 | 1 | 1 | 1 | 1 | 0 | 0 | 0 | 1 | T22 |
| | | 1 | 1 | 0 | 0 | 1 | 0 | 0 | 0 | 1 | T23 |
| | | 1 | 0 | 1 | 0 | 1 | 0 | 0 | 0 | 1 | T24 |

*Fig.8A*

Truth Table for Third Mask Pattern

| DH | DL | V3 | V2 | V1 | V0 | /Q3 | /Q2 | /Q1 | /Q0 | MSK | Cell |
|---|---|---|---|---|---|---|---|---|---|---|---|
| 0 | 0 | 1 | 1 | 1 | 1 | 0 | 0 | 0 | 1 | 1 | T21 |
| | | 0 | 0 | 0 | 0 | 0 | 0 | 0 | 0 | 0 | T22 |
| | | 1 | 1 | 0 | 0 | 0 | 0 | 0 | 0 | 0 | T23 |
| | | 1 | 0 | 1 | 0 | 0 | 0 | 0 | 0 | 0 | T24 |
| 0 | 1 | 1 | 1 | 1 | 1 | 0 | 0 | 1 | 0 | 1 | T21 |
| | | 0 | 0 | 0 | 0 | 0 | 0 | 0 | 0 | 0 | T22 |
| | | 1 | 1 | 0 | 0 | 0 | 0 | 0 | 0 | 0 | T23 |
| | | 1 | 0 | 1 | 0 | 0 | 0 | 1 | 0 | 1 | T24 |
| 1 | 0 | 1 | 1 | 1 | 1 | 0 | 1 | 0 | 0 | 1 | T21 |
| | | 0 | 0 | 0 | 0 | 0 | 0 | 0 | 0 | 0 | T22 |
| | | 1 | 1 | 0 | 0 | 0 | 1 | 0 | 0 | 1 | T23 |
| | | 1 | 0 | 1 | 0 | 0 | 0 | 0 | 0 | 0 | T24 |
| 1 | 1 | 1 | 1 | 1 | 1 | 1 | 0 | 0 | 0 | 1 | T21 |
| | | 0 | 0 | 0 | 0 | 0 | 0 | 0 | 0 | 0 | T22 |
| | | 1 | 1 | 0 | 0 | 1 | 0 | 0 | 0 | 1 | T23 |
| | | 1 | 0 | 1 | 0 | 1 | 0 | 0 | 0 | 1 | T24 |

*Fig.8B*

Truth Table for Fourth Mask Pattern

| DH | DL | V3 | V2 | V1 | V0 | /Q3 | /Q2 | /Q1 | /Q0 | MSK | Cell |
|---|---|---|---|---|---|---|---|---|---|---|---|
| 0 | 0 | 1 | 1 | 1 | 1 | 0 | 0 | 0 | 1 | 1 | T21 |
| | | 1 | 1 | 1 | 1 | 0 | 0 | 0 | 1 | 1 | T22 |
| | | 1 | 1 | 0 | 0 | 0 | 0 | 0 | 0 | 0 | T23 |
| | | 1 | 0 | 1 | 0 | 0 | 0 | 0 | 0 | 0 | T24 |
| 0 | 1 | 1 | 1 | 1 | 1 | 0 | 0 | 1 | 0 | 1 | T21 |
| | | 1 | 1 | 1 | 1 | 0 | 0 | 1 | 0 | 1 | T22 |
| | | 1 | 1 | 0 | 0 | 0 | 0 | 0 | 0 | 0 | T23 |
| | | 1 | 0 | 1 | 0 | 0 | 0 | 1 | 0 | 1 | T24 |
| 1 | 0 | 1 | 1 | 1 | 1 | 0 | 1 | 0 | 0 | 1 | T21 |
| | | 1 | 1 | 1 | 1 | 0 | 1 | 0 | 0 | 1 | T22 |
| | | 1 | 1 | 0 | 0 | 0 | 1 | 0 | 0 | 1 | T23 |
| | | 1 | 0 | 1 | 0 | 0 | 0 | 0 | 0 | 0 | T24 |
| 1 | 1 | 1 | 1 | 1 | 1 | 1 | 0 | 0 | 0 | 1 | T21 |
| | | 1 | 1 | 1 | 1 | 1 | 0 | 0 | 0 | 1 | T22 |
| | | 1 | 1 | 0 | 0 | 1 | 0 | 0 | 0 | 1 | T23 |
| | | 1 | 0 | 1 | 0 | 1 | 0 | 0 | 0 | 1 | T24 |

Fig. 10A Dot Types Formable with First Mask Pattern

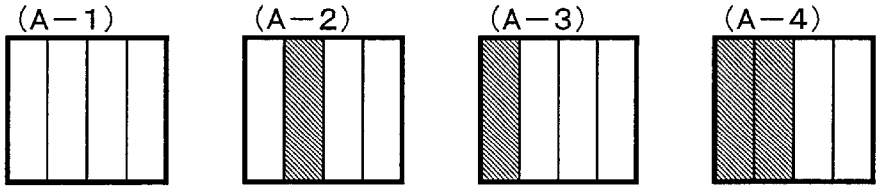

Fig. 10B Dot Types Formable with Second Mask Pattern

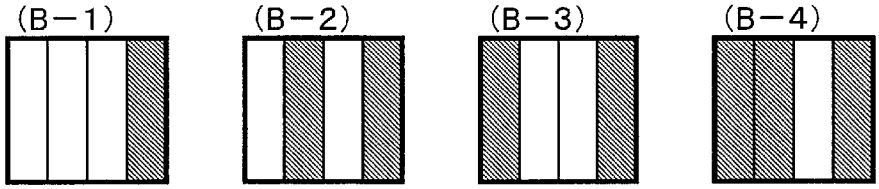

Fig. 10C Dot Types Formable with Third Mask Pattern

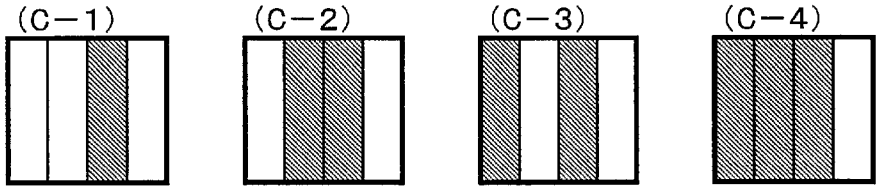

Fig. 10D Dot Types Formable with Fourth Mask Pattern

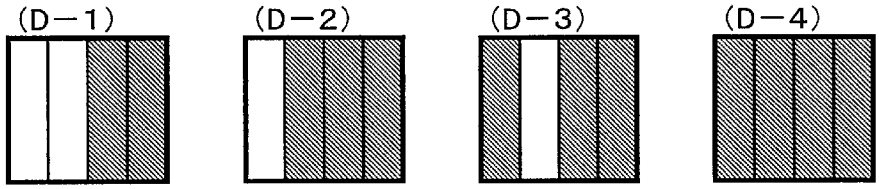

Fig. 10E

| MPS | Mask Pattern |
|---|---|
| 00 | First Mask Pattern |
| 01 | Second Mask Pattern |
| 10 | Third Mask Pattern |
| 11 | Fourth Mask Pattern |

Fig. 10F

| DTS | First Mask Pattern | Second Mask Pattern | Third Mask Pattern | Fourth Mask Pattern |
|---|---|---|---|---|
| 00 | (A−1) | (B−1) | (C−1) | (D−1) |
| 01 | (A−2) | (B−2) | (C−2) | (D−2) |
| 10 | (A−3) | (B−3) | (C−3) | (D−3) |
| 11 | (A−4) | (B−4) | (C−4) | (D−4) |

Fig. 11A

Original Masking Signal Data Contained in First Mask Pattern

| | (A−1) | (A−2) | (A−3) | (A−4) |
|---|---|---|---|---|
| Forward Pass | 0 0 0 0 | 0 1 0 0 | 1 0 0 0 | 1 1 0 0 |
| Return Pass | 0 0 0 0 | 0 0 1 0 | 0 0 0 1 | 0 0 1 1 |

Fig. 11B

Original Masking Signal Data Contained in Second Mask Pattern

| | (B−1) | (B−2) | (B−3) | (B−4) |
|---|---|---|---|---|
| Forward Pass | 0 0 0 1 | 0 1 0 1 | 1 0 0 1 | 1 1 0 1 |
| Return Pass | 1 0 0 0 | 1 0 1 0 | 1 0 0 1 | 1 0 1 1 |

Fig. 11C

Original Masking Signal Data Contained in Third Mask Pattern

| | (C−1) | (C−2) | (C−3) | (C−4) |
|---|---|---|---|---|
| Forward Pass | 0 0 1 0 | 0 1 1 0 | 1 0 1 0 | 1 1 1 0 |
| Return Pass | 0 1 0 0 | 0 1 1 0 | 0 1 0 1 | 0 1 1 1 |

Fig. 11D

Original Masking Signal Data Contained in Fourth Mask Pattern

| | (D−1) | (D−2) | (D−3) | (D−4) |
|---|---|---|---|---|
| Forward Pass | 0 0 1 1 | 0 1 1 1 | 1 0 1 1 | 1 1 1 1 |
| Return Pass | 1 1 0 0 | 1 1 1 0 | 1 1 0 1 | 1 1 1 1 |

PRINTING WITH VARIED TYPES OF INK DOTS

BACKGROUND OF THE INVENTION

1. Field of the Invention

The present invention relates to a technology for ejecting ink onto a print medium to print images.

2. Description of the Related Art

In recent years, color printers of the type in which inks of multiple colors are ejected from an ink head have become popular as output devices for computers and are now widely used in processes in which images processed by computers are printed in numerous colors and gradations. Such printers are usually provided with improved print resolution and/or dot variation in order to improve image quality.

However, improving print resolution and/or dot variation is accompanied by an increase in the amount of data being processed. The resulting drawback is that, in particular, considerable time is needed to transfer data within a printing apparatus and between computers and the printing apparatus, resulting in reduced printing speed.

SUMMARY OF THE INVENTION

Accordingly, an object of the present invention is to provide a technique for increasing the number of available dot types to improve image quality while minimizing the reduction in printing speed.

In order to attain the above and the other objects of the present invention, there is provided a printing apparatus capable of selectively forming any of N types of dots which are different in at least one of an ink amount and a dot-formed position in a pixel area on a print medium. N is an integer of at least two. The printing apparatus comprises a print head and a drive signal generator. The print head has a plurality of nozzles and a plurality of ejection drive elements for ejecting ink drops from corresponding plurality of nozzles. The drive signal generator is configured to generate drive signals for driving the ejection drive elements to form one of the N types of dots in each pixel area in response to print signals. Each print signal for one pixel including 2 types of mask selection data. The 2 types of mask selection data are indicative of one type of masking signal among a plurality of types of masking signals corresponding to the N types of dots. The drive signal generator comprises an original drive signal generator, a mask signal generator, and a masking unit. The original drive signal generator is configured to generate an original drive signal having a plurality of pulses within a main scan period for a single pixel. The original drive signal is commonly applicable to the plurality of ejection drive elements. The mask signal generator is configured to select one type of masking signal from the plurality of type of masking signals in response to the 2 types of mask selection data in order to generate the masking signal. The masking unit is configured to selectively mask the plurality of pulses in the original drive signal using the generated masking signal in order to generate the drive signal to be supplied to the each ejection drive element.

In the printing of the present invention, the drive signals are generated using the mask signals selected with the two types of mask selection data. Therefore, it is possible to increase the number of dot types available by the printing apparatus, to thereby improve image quality.

The present invention can be realized in various forms such as a method and apparatus for printing, a method and apparatus for producing print data for a printing unit, and a computer program product implementing the above scheme.

These and other objects, features, aspects, and advantages of the present invention will become more apparent from the following detailed description of the preferred embodiments with the accompanying drawings.

BRIEF DESCRIPTION OF THE DRAWINGS

FIGS. 6A–6I are timing charts showing operation of the drive signal generator 306;

FIGS. 7A and 7B are illustrative diagrams showing truth tables of the masking signal generation circuit for obtaining a mask signal using the first or the second mask pattern;

FIGS. 8A and 8B are illustrative diagrams showing truth tables of the masking signal generation circuit for obtaining a mask signal using the third or the fourth mask pattern;

FIGS. 10A–10F are illustrative diagrams showing dot types formable with a plurality of mask patterns; and FIGS. 11A–11D are diagrams depicting the original masking signal data stored in the mask pattern storage during forward and return passes.

DESCRIPTION OF THE PREFERRED EMBODIMENT

The present invention is explained in the following sequence based on an embodiment.

A. Apparatus Structure:

B. Specifics of Printing Process:

C. Modifications:

A. Apparatus Structure:

A. Overall Arrangement of Printing Apparatus

Figure 1:
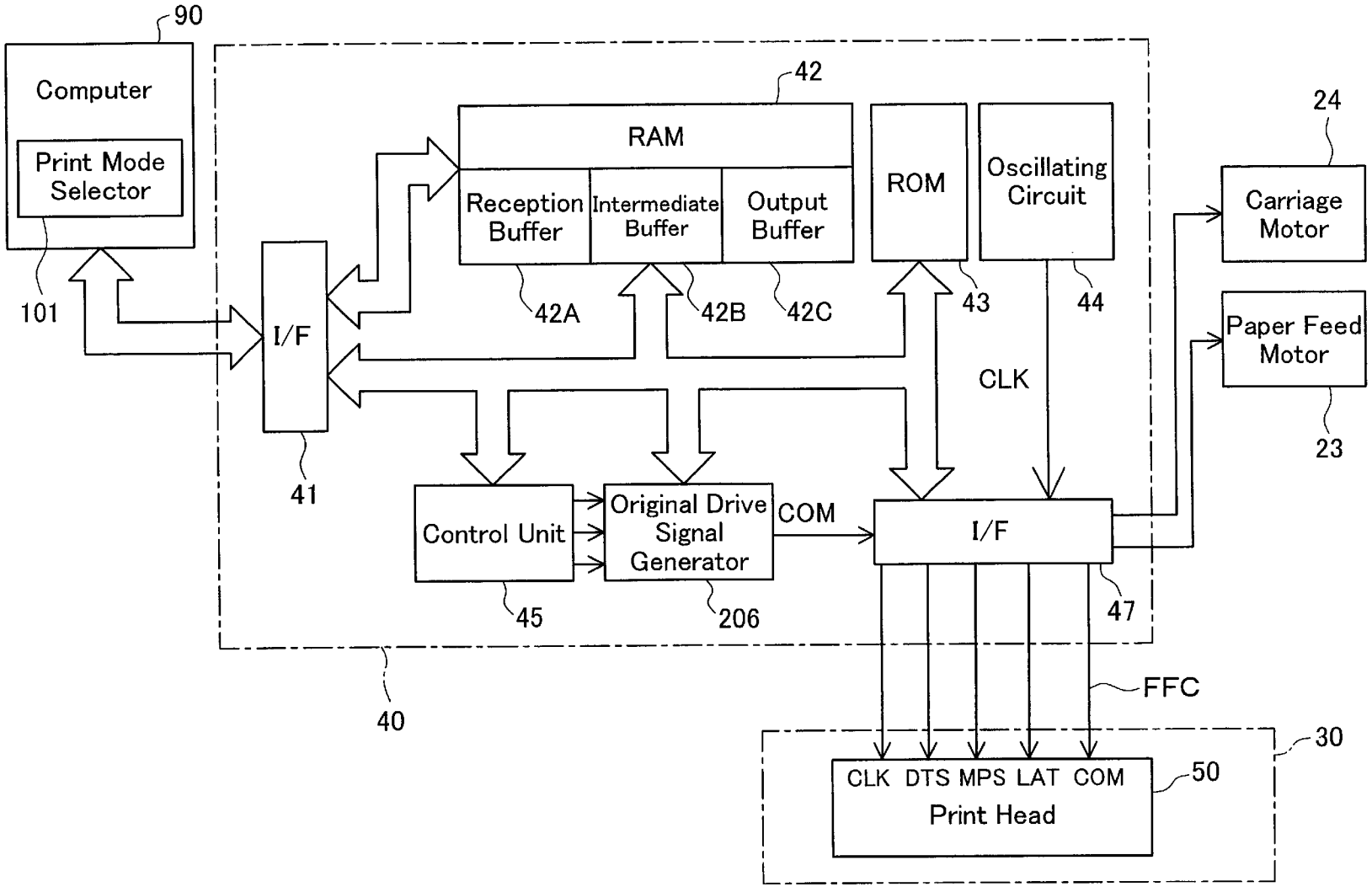
FIG. 1 is a block diagram depicting the entire structure of the printing apparatus of an embodiment of the present invention.

FIG. 1 is a block diagram depicting the entire structure of the printing apparatus according to the present invention. The printing apparatus comprises a control circuit 40, a paper feed motor 23, a carriage motor 24 for performing main scan, and a print head 50 with a mounted carriage 30, as shown in FIG. 1.

The computer 90 runs application programs under a specific operating system. A Video driver and a printer driver (not shown) are incorporated into the operating system to allow images to be displayed or various video routines to be performed. The computer 90 is provided with a print mode selector 101 for allowing the user to select print modes including a text mode. Its functions are described below.

The control circuit 40 comprises an interface 41 for receiving print signal and so on from the computer 90, a RAM 42 for storing various types of data, a ROM 43 containing routines for various types of data processing, an oscillating circuit 44, a control unit 45 having a CPU (not shown), an original drive signal generator 206, and an interface 47 for sending print signals or drive signals to the paper feed motor 23, carriage motor 24, or print head 50.

RAM 42 is used as a reception buffer 42A, intermediate buffer 42B, or output buffer 42C. The print data PD from the computer 90 are stored in the reception buffer 42A via the interface 41. These data are converted to an intermediate code and are stored in the intermediate buffer 42B. Control unit 45 processes to develop dot data representing dot recording status for each pixel referencing font data and graphics functions in ROM 43.

By predetermined processing of dot data, a print signal PRT including two types of mask selection data is generated. The two types of mask selection data consist of dot type selection data DTS and mask pattern selection data MPS. The dot type selection data DTS and mask pattern selection data MPS are described later. Print signal PRT is stored in output buffer 42C. The print signal PRT is stored in output buffer 42C is connected to the print head 50 via interface 47 and a cable called a flexible flat cable(FFC). The cable FFC connects over the considerable distance between the print head 50 and the control circuit 40. The cable FFC is deformable so as to be able to follow movement of the carriage 30 on which the print head 50 rides.

Herein, portions of the printing apparatus other than carriage 30 and cable FFC are referred to as the "printing apparatus main body" or simply "main body". The "main body" differs from the carriage 30 in that there is no need to move in order to perform printing.

Figure 2:
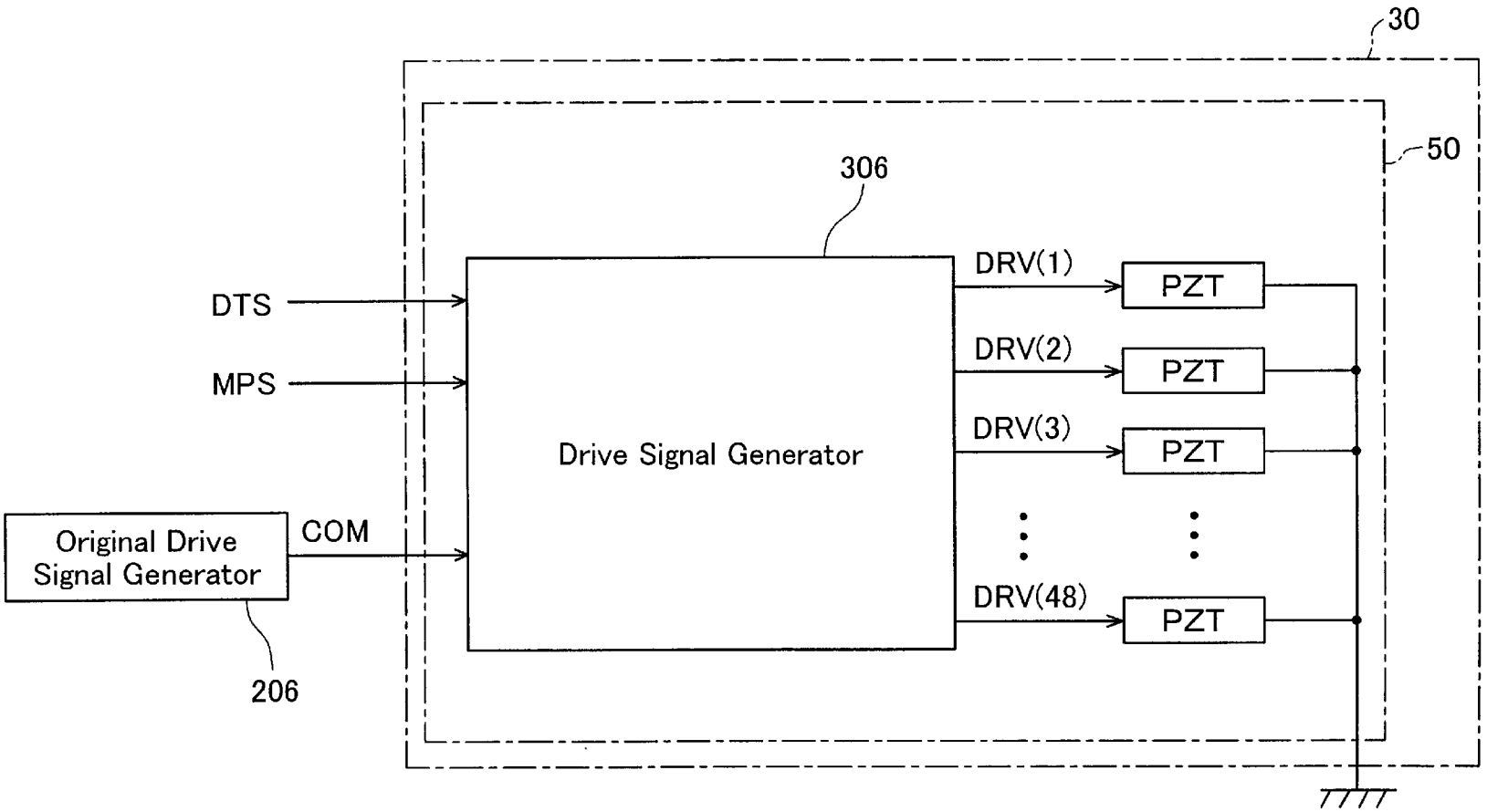
FIG. 2 is a block diagram depicting the structure of a print head 50 in accordance with the embodiment of the present invention.

FIG. 2 is a block diagram depicting the structure of a print head 50 in accordance with the embodiment of the present invention. Print head 50 comprises a drive signal generator 306, and ejection drive elements PZT for ejecting ink drops from the nozzles. Drive signal generator 306 performs shaping of a original drive signal COM received from a original drive signal generator 206, in response to the mask pattern selection data MPS and dot type selection data DTS, to generate a drive signal DRV(i) for each individual nozzle. Drive signals DRV(i) are sent to ejection drive elements PZT, and ink drops are ejected from the nozzles in response to these signals.

Figure 3:
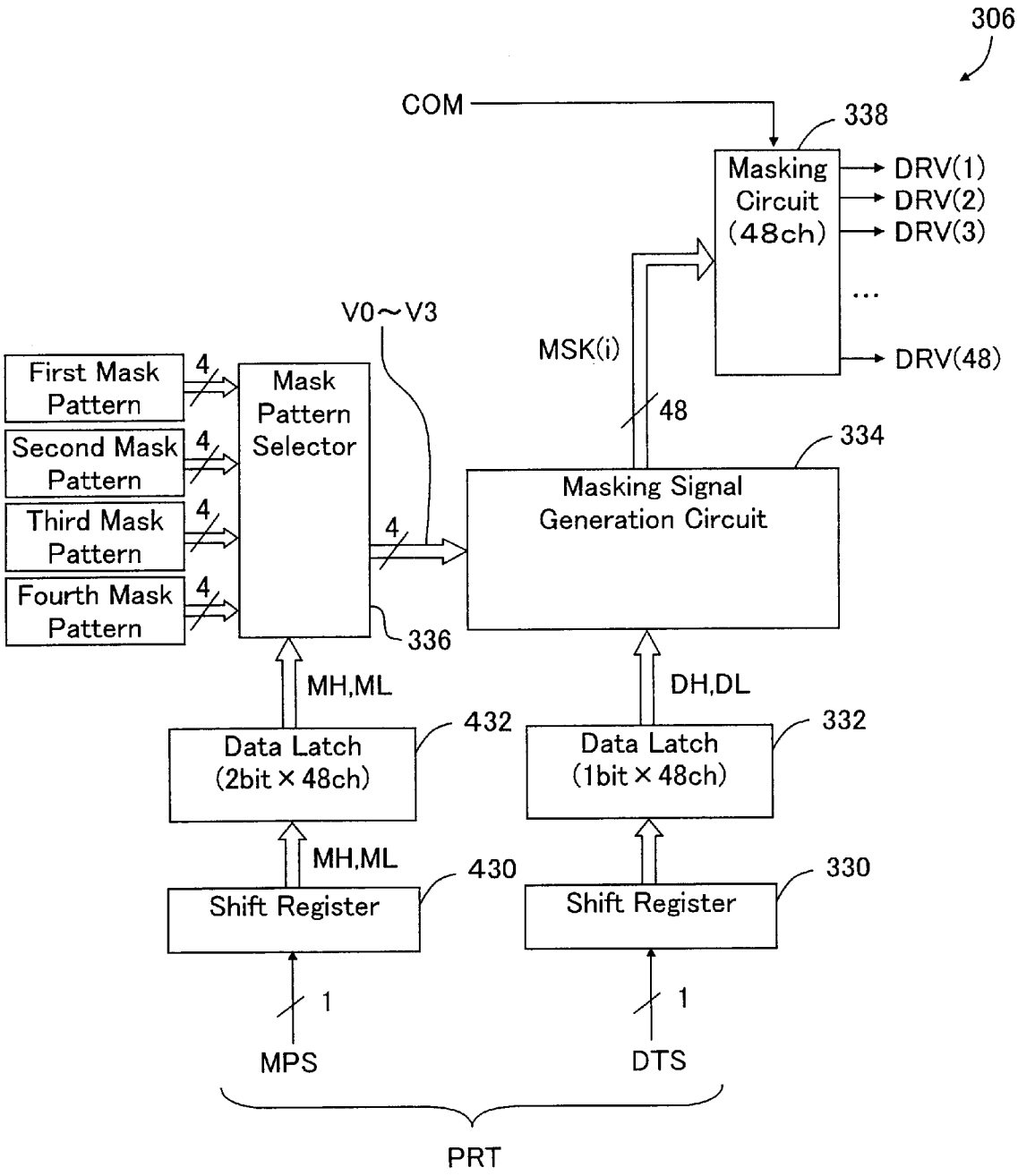
FIG. 3 is a block diagram showing the internal arrangement of drive signal generator 306.

FIG. 3 is a block diagram showing the internal arrangement of drive signal generator 306. Drive signal generator 306 comprises shift registers 330, 430, data latches 332, 432, a masking signal generation circuit 334, a mask pattern selector 336, and a masking circuit 338. Masking circuit 338 is also referred to as a masking unit.

Shift register 430 converts the mask pattern selection data MPS included in the serial print signal supplied by computer 90 into 2-bit×48-channel parallel data. Here, "1 channel" means a portion of the signal assigned to one nozzle. Mask pattern select data MPS for one pixel of one nozzle is composed of two bits, an upper bit MH and a lower bit ML. Mask pattern selector 336 selects one of four mask patterns for each channel, with reference to the 2-bit mask pattern selection data MPS (MH, ML). Original masking signal data V0–V3 included in the selected mask pattern is presented by mask pattern selector 336 to the masking signal generation circuit 334.

Shift register 330 converts the dot type selection data DTS included in the serial print signal supplied by computer 90 into 2-bit×48-channel parallel data. Like the mask pattern selection data MPS, dot type selection data DTS for one pixel of one nozzle is composed of two bits, an upper bit DH and a lower bit DL. Mask signal generation circuit 334 generates a 1-bit mask signal MSK(i) (i=1–48) for each channel with reference to the original masking signal data V0–V3 provided by mask pattern selector 336, as described earlier, and the 2-bit dot type selection data DTS (DH, DL). A single type of dot is produced or recorded in response to the generated mask signal MSK(i). The dot type selection data DTS thus performs the function of selecting the dot type to be produced at each pixel.

Masking circuit 338 is a switching circuit for masking all or part of the signal waveform of original drive signal COM within one pixel interval, with reference to the supplied mask signal MSK (i). Configuration and operation of the mask pattern selector 336 and the masking signal generation circuit 334 is described later. The mask pattern selector 336 and the masking signal generation circuit 334 correspond to mask signal generator in the appended claims.

B. Specifics of Printing Process

Figure 4:
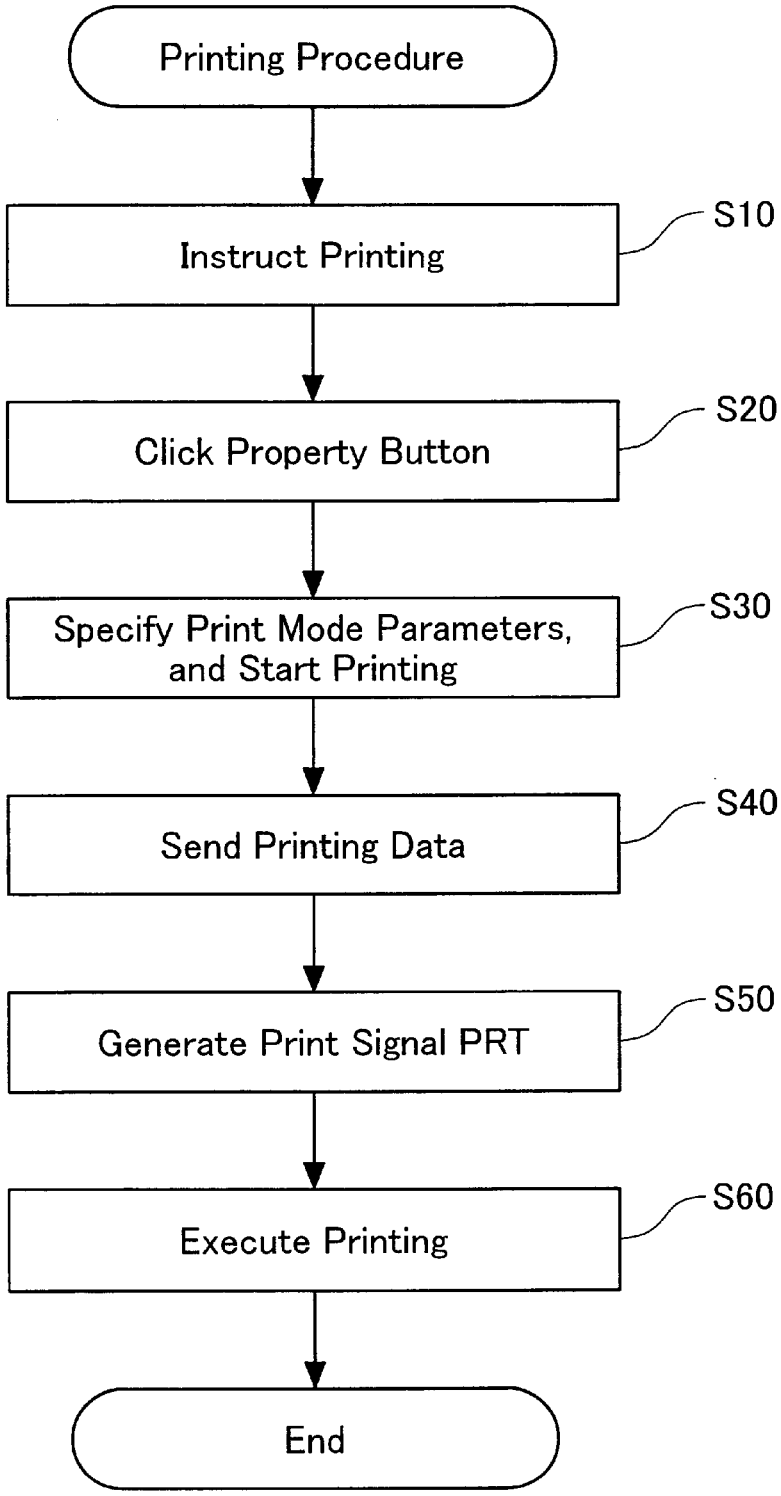
FIG. 4 is a flowchart depicting the sequence adopted to perform a printing procedure in accordance with the embodiment of the present invention.
Figure 5:
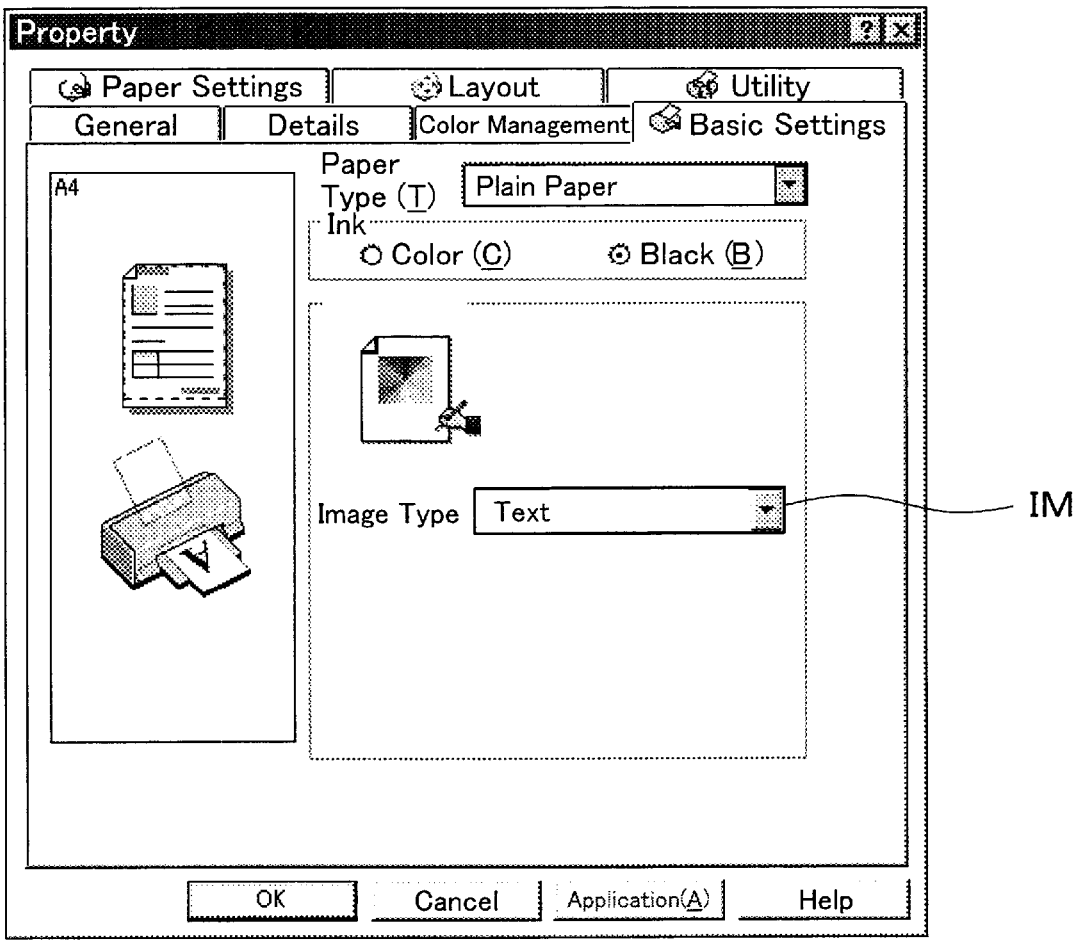
FIG. 5 is a diagram depicting an example of a basic settings screen for displaying print modes on a CRT 21.

FIG. 4 is a flowchart depicting the sequence adopted to perform a printing procedure in accordance with the embodiment of the present invention. In Step S10, the user inputs a Print command to computer 90. In Step S20, clicking on the Properties Button (not shown) in the Print dialog box displayed on CRT 21 causes the print mode selector 101 (FIG. 1) to display on CRT 21 the Properties Settings screen shown in FIG. 5.

From the Properties Settings screen the user is able to set various parameters specifying print mode. The basic print mode settings screen in FIG. 5 has a menu for specifying various parameters, and includes a Select Image Type menu IM. The Select Image Type menu IM is a pull-down menu that allows one to select an item from a list of image types such as Text, Photograph, etc.

In the Details settings screen for print mode, the user can set other additional parameters, but these other parameters will not be described here.

In Step S30 in FIG. 4, when the user selects the image type and issues a command to start printing, print data PD is sent from computer 90 to control circuit 40 (S40). This print data PD includes data for generating dot data in control circuit 40, and information indicative of the selected print mode. Here it is assumed that the print mode is text print mode, and that the dot data generated in control circuit 40 is binary data having resolution of 1440 dpi in the main scan direction and resolution of 360 dpi in the sub-scan direction.

In Step S50, control unit 45 generates a print signal PRT by processing the dot data. The print signal PRT is converted to dot data for each 4 consecutive pixels in the main scan direction to generate combinations of mask pattern selection data MPS and dot type selection data DTS for each single pixel. That is, binary data having resolution of 1440 dpi in the main scan direction and resolution of 360 dpi in the sub-scan direction is converted to a print signal PRT for producing multiple types of dot having resolution of 360 dpi in the main scan direction and resolution of 360 dpi in the sub-scan direction. The control unit 45 corresponds to the print signal generator recited in the claims.

This process is performed such that the most similar type of dot to a dot hypothetically recorded with the binary dot data having resolution of 1440 dpi is recorded. The most similar type of dot is recorded with a print signal PRT having resolution of 360 dpi in the main scan direction. This print signal PRT (i.e. combinations of mask pattern selection data MPS and dot type selection data DTS) is sent to the print head 50 via the aforementioned FFC. Print head 50 ejects ink drops onto the print medium in accordance with the print signal PRT sent to it.

FIGS. 6A–6I are timing charts showing operation of the drive signal generator 306. The operation shows the process for generating a drive signal DRV for generating four types of dot that are generated using a first mask pattern. FIG. 6A shows a original drive signal COM output by the original drive signal generator 206. As shown in FIG. 6A, the original drive signal COM in this embodiment includes four pulses W0 of identical waveform between four sub-intervals of one pixel interval. As used herein "one pixel interval" refers to the period in which the type of dots to be produced at each pixel location on paper P is determined, in other words, the period for producing dots of type differing in size and/or placement at each pixel location.

FIGS. 6B–6E show a first mask signal MSK(i) for producing a first dot type, a second mask signal MSK(i) for producing a second dot type, a third mask signal MSK(i) for producing a third dot type, and a fourth mask signal MSK(i) for producing a fourth dot type. These signals are output by masking signal generation circuit 334 (FIG. 3), and control masking circuit 338. Masking circuit 338 functions as a switch situated between the original drive signal generator 206 and the ejection drive elements PZT, and selectively pass the four pulses W0 during one pixel interval. Masking circuit 338 is an analog switch that passes the original drive signal COM when a mask signal MSK(i) is "1", and blocks the original drive signal COM when a mask signal MSK(i) is "0".

Each mask signal MSK(i) is a signal that assumes a value of "1" or "0" during each sub-interval of a single pixel interval. The first mask signal MSK(i) (FIG. 6B) is a signal that assumes a value of "0" throughout an entire single pixel interval. The second mask signal MSK(i) (FIG. 6C) is a signal that assumes a value of "0" during the first through third sub-intervals, and a value of "1" during the fourth sub-interval. The third mask signal MSK(i) (FIG. 6D) is a signal that assumes a value of "0" during the first, second and fourth sub-intervals, and a value of "1" during the third sub-interval. The fourth mask signal MSK(i) (FIG. 6E) is a signal that assumes a value of "0" during the first and second sub-intervals, and a value of "1" during the third and fourth sub-intervals.

FIGS. 6F–6I show drive signals DRV(i) output by the masking circuit 338. As noted, drive signals DRV(i) are signals resulting from the original drive signal COM being allowed to pass during periods that mask signal MSK(i) is "1". Accordingly, the first drive signal (FIG. 6F) contains no pulses W0. The second drive signal (FIG. 6G) contains a pulse W0 in the fourth sub-interval. The third drive signal (FIG. 6H) contains a pulse W0 in the third sub-interval. The fourth drive signal (FIG. 6I) contains pulses W0 in the third and fourth sub-intervals.

The drive signals DRV are sent to the ejection drive elements PZT, whereupon ink drops are ejected from the nozzles. Specifically, in response to the first drive signal there is produced a first dot type (i.e. blank) for which no ink drops are ejected. An ink drop is ejected in the fourth sub-interval in response to the second drive signal. An ink drop is ejected in the third sub-interval in response to the third drive signal. Two ink drops are ejected in the third and fourth sub-intervals in response to the fourth drive signal. These ejected ink drops produce dots of the first type, the second type, third type and fourth type, respectively.

FIGS. 7A and 7B are illustrative diagrams showing truth tables of the masking signal generation circuit 334 (FIG. 3) for obtaining a mask signal MSK(i) using the first or the second mask pattern. FIG. 7A is the truth table for the first mask pattern. The first original masking signal data V0 included in the first mask pattern is 0, 0, 0, 0 during intervals T21–T24 and does not change. The second original masking signal data V1 changes to 0, 0, 0, 1; the third original masking signal data V2 changes to 0, 0, 1, 0; and the fourth original masking signal data V3 changes to 0, 0, 1, 1.

The masking signal generation circuit 334 is configured such that when the value "DHDL" of dot type selection data DTS (DH, DL) is "00", the change in the level of a mask signal MSK(i) is identical to the change in level of the first original masking signal data V0. As a result, during intervals T21–T24, masking signal generation circuit 334 generates a mask signal that assumes the values 0, 0, 0, 0. These values all match the values of the mask signal MSK(i) shown in FIG. 6B. Similarly, when the value of dot type selection data DTS in FIG. 7A is "01", "10" or "11", the change in mask signal MSK(i) will match the change shown in FIG. 6C, 6D or 6E, respectively.

FIG. 7B is a truth table for the second mask pattern. As shown in FIG. 7B, original masking signal data V0, V1, V2 and V3 included in the second mask pattern differs from the original masking signal data V0, V1, V2 and V3 included in the first mask pattern. FIGS. 8C and 8D show additional truth tables using different third and fourth mask patterns.

Figure 9:
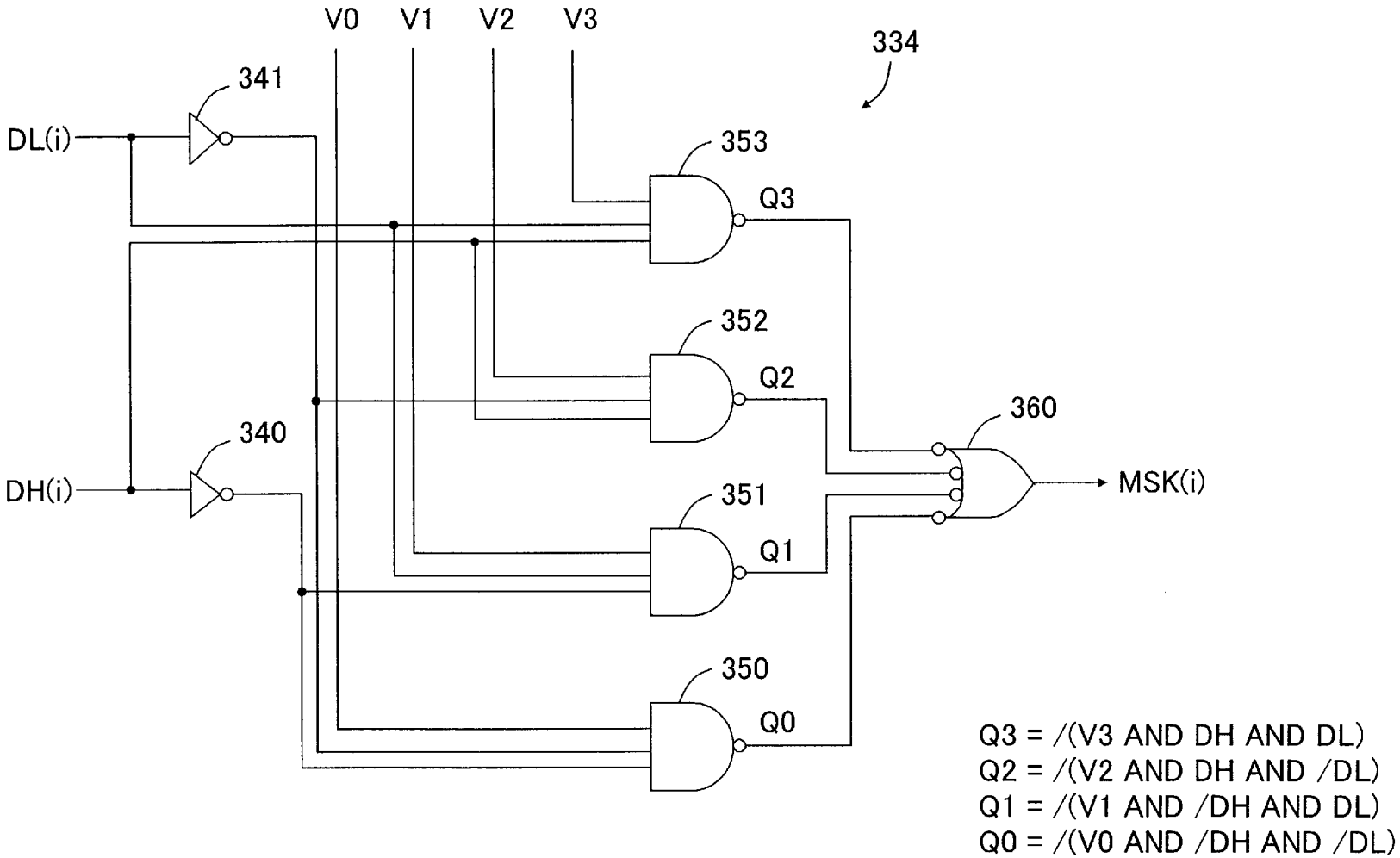
FIG. 9 is a block diagram depicting the inner structure of the masking signal generation circuit in accordance with the first embodiment of the present invention.

FIG. 9 is a block diagram showing the internal arrangement of masking signal generation circuit 334. Mask signal generation circuit 334 comprises two inverters 340, 341, four NAND circuits 350–353, and a NAND circuit 360. The four NAND circuits 350–353 performs logical operations with regard to dot type selection data DTS (DH, DL) and one of original masking signal data V0–V3. The NAND circuit 360 outputs mask signal MSK(i).

The four NAND circuits 350–351 are connected such that their outputs Q0–Q3 may be expressed by the following Boolean equations (1)–(4):

$$Q0=/(V0 \text{ AND } /DH \text{ AND } /DL) \quad (1)$$

$$Q1=/(V1 \text{ AND } /DH \text{ AND } DL) \quad (2)$$

$$Q2=/(V2 \text{ AND } DH \text{ AND } /DL) \quad (3)$$

$$Q3=/(V3 \text{ AND } DH \text{ AND } DL) \quad (4)$$

Here the symbol "/" preceding the signal name indicates an inverted signal.

The final NAND circuit 360 takes the outputs Q0–Q3 of the four NAND circuits 350–353 and generates a mask signal MSK(i) according to the following Boolean equation:

$$MSK=(/Q0 \text{ OR } /Q1 \text{ OR } /Q2 \text{ OR } /Q3) \quad (5)$$

As will be readily appreciated from the preceding Boolean equations (1)–(5), when the value "DHDL" of the 2-bit dot type selection data DTS is "00", the level of mask signal MSK(i) is identical to first original masking signal data V0. When the value of dot type selection data DTS is "01", "10" or "11", the level of mask signal MSK(i) is identical to original masking signal data V1, V2 or V3, respectively. Accordingly, by changing the value of the original masking signal data V0–V3, it is possible to arbitrarily set the value of the mask signal MSK(i) corresponding to the dot type selection data DTS.

In this way, the drive signal generator 306 is able to produce four types of dots, based on a single mask pattern. Further, since mask pattern can be changed during each pixel interval, many types of dot can be produced. Specifically, Q types of dot can be produced with a single mask pattern, and where P types of mask pattern can be used, a maximum of P×Q types of dot can be produced. Change of mask pattern is achieved by the mask pattern selector 336, by means of a process analogous to that of the masking signal generation circuit 334.

FIG. 10 is an illustrative diagram showing dot types formable with a plurality of mask patterns. FIG. 10A shows dot types formable with the first mask pattern; FIG. 10B shows dot types formable with the second mask pattern; FIG. 10C shows dot types formable with the third mask pattern; and FIG. 10D shows dot types formable with the fourth mask pattern.

FIG. 10E is an illustrative diagram showing relationships of mask pattern selection data MPS and selected mask pattern. As shown in FIG. 10E, when mask pattern selection data MPS is "00", the first mask pattern is selected. Similarly, when mask pattern selection data MPS is "01", the second mask pattern is selected; when mask pattern selection data MPS is "10", the third mask pattern is selected; and when mask pattern selection data MPS is "11", the fourth mask pattern is selected.

FIG. 10F is an illustrative diagram showing relationships of dot type selection data DTS and selected dot type. As shown in FIG. 10F, one dot type can be selected in response to the dot type selection data DTS when a mask pattern is selected. For example, when the first mask pattern is selected for the pixel interval of any nozzle, one dot type can be selected as follows. When dot type selection data is "00", the dot type (A-1) is selected. When dot type selection data is "01", the dot type (A-2) is selected. When dot type selection data is "10", the dot type (A-3) is selected. When dot type selection data is "11", the dot type (A-4) is selected.

As described hereinabove, in this embodiment dot data representing high-resolution dot recording status is processed to generate a low-resolution print signal, and represented using multiple types of dot at relatively low resolution. This process reduces a decline in image quality in the case of print resolution drops for any of a variety of reasons. In this embodiment, there is a particular notable advantage in reproducing smooth outlines for text printing.

In this embodiment, mask pattern selection data MPS and dot type selection data DTS can be transferred from control circuit 40 to print head 50 in parallel. As noted, the cable FFC connecting the control circuit 40 and print head 50 connects over the considerable distance between the print head 50 and the control circuit 40, and is deformable so as to be able to follow movement of the carriage 30 on which the print head 50 rides. With such a cable, high speed data transmission is generally relatively difficult, so reducing communications traffic through the cable FFC is advantageous in terms of increasing printing speed.

C. Modifications

The present invention is not limited by the above-described embodiments or embodiments and can be implemented in a variety of ways as long as the essence thereof is not compromised. For example, the following modifications are possible.

C-1. The present invention can also be adapted to bidirectional printing. With bidirectional printing, the aforementioned the original masking signal data should preferably be prepared in the mask patterns such that mutually reversed original masking signal data are selected during forward and return passes, as shown in FIG. 11. Adopting this arrangement allows the extent to which the dots thus formed drift in the direction of main scan to be controlled during forward and return passes.

C-2. In the preceding embodiment, various dots are recorded with four ink drops ejected at different timing at 360 dpi resolution for dot data of 1440 dpi resolution in the main scan direction. However, it would also be acceptable to produce dots with three ink drops ejected at different timing. Generally, various dots may be produced with at most R inks drops ejected at different timing at resolution L/R for dot data of resolution L in the main scan direction in the main scan direction.

C-3. In the preceding embodiment, 16 types of dots are reproducible with four binary pixels, for example, 8 types of dots could be represented by assigning eight types of dot instead of the 16 types of image. Suppose 8 types of dots are types of (A-1), (B-1), (B-2), (B-3), (C-2), (C-3), (C-4), and (D-4) in FIGS. 10A–10D, other 8 types of images are not reproducible. (A-1) type of dot may be reproducible by using available (C-1) type of dot which is close to (A-1) type of dot. In general, it is acceptable to select a dot pattern that is one of available dot types and closest to an exact dot pattern represented by the binary dot.

C-4. In the preceding embodiment, dot data representing dot recording status for each pixel is reproduced at relatively low resolution with various dots reproduced with ink drops ejected in different numbers or at different locations. However, it would be acceptable to instead reproduce it with ink drops of different volume. In general, the printing apparatus herein may selectively record a plurality of dot types differing in ink amount and/or formed position for a single pixel area.

C-5. In the preceding embodiment, the print signal PRT is generated by means of the printer 20 processing dot data received from a computer 90 and representing dot production status for each pixel. However, a print signal generated by computer 90 could be sent to printer 20 instead of the dot data.

C-6. The invention is also applicable to a drum printer. In a drum printer the direction of drum rotation is the main scan direction, and the direction of carriage travel is the sub-scan direction. The invention is not limited to ink-jet printers, but is applicable generally to any printing apparatus that performs printing onto the surface of a print medium using a print head equipped with a plurality of nozzles.

Some or all of the functions performed by hardware in the preceding embodiment could instead by performed by software; and conversely some or all of the functions performed by software in the preceding examples could instead by performed by hardware. For example, some or all of the functions of printer driver 96 shown in FIG. 1 could be performed by the control circuit 40 in printer 20. In this case, some or all of the functions of computer 90 as the printing control device for producing print data would instead be assumed by the control circuit 40 in printer 20.

Where some or all of the functions herein are realized through software, the software (computer program) may be provided in a form stored on a computer-readable storage medium. "Computer-readable storage medium" is not limited herein to a flexible disk, CD-ROM or other portable storage medium, but includes also computer internal storage devices such as RAM or ROM of various kinds, and external storage devices fixed to a computer, such as a hard disk.

Although the present invention has been described and illustrated in detail, it is clearly understood that the same is by way of illustration and example only and is not to be taken by way of limitation, the spirit and scope of the present invention being limited only by the terms of the append claims.

What is claimed is:

1. A printing apparatus capable of selectively forming any of N types of dots which are different in at least one of an ink amount and a dot-formed position in a pixel area on a print medium, N being an integer of at least 2, comprising:

a print head having a plurality of nozzles and a plurality of ejection drive elements for ejecting ink drops from corresponding plurality of nozzles; and a drive signal generator configured to generate drive signals for driving the ejection drive elements to form one of the N types of dots in each pixel area in response to print signals, each print signal for one pixel including 2 types of mask selection data, the 2 types of mask selection data being indicative of one type of masking signal among a plurality of types of masking signals corresponding to the N types of dots;

wherein the drive signal generator comprises:

an original drive signal generator configured to generate an original drive signal having a plurality of pulses within a main scan period for a single pixel, the original drive signal being commonly applicable to the plurality of ejection drive elements;

a mask signal generator configured to select one type of masking signal from the plurality of type of masking signals in response to the 2 types of mask selection data in order to generate the masking signal; and a masking unit configured to selectively mask the plurality of pulses in the original drive signal using the generated masking signal in order to generate the drive signal to be supplied to the each ejection drive element.

2. The printing apparatus in accordance with claim 1, wherein the 2 types of mask selection data include:

a mask pattern selection data for selecting for each pixel one type of mask pattern from a plurality of types of mask patterns; and a dot type selection data for selecting for each pixel one type of original masking signal data from a plurality of types of original masking signal data included in each of the plurality of types of mask patterns; and wherein the mask signal generator comprises:

a mask pattern selector configured to select one type of mask pattern from the plurality of types of mask pattern in response to the mask pattern selection data; and a masking signal generation circuit configured to select one type of original masking signal data from the plurality of types of original masking signal data included in the selected mask pattern in response to the dot type selection data, and to generate the masking signal using the selected original masking signal data.

3. The printing apparatus in accordance with claim 2, wherein a number of types of the mask patterns is P, P being an integer of at least 2; and each mask pattern includes Q types of original masking signal data corresponding to Q types of dots, Q being N divided by P.

4. The printing apparatus in accordance with claim 2 further comprising:

a print mode selector allowing a user to select one of a plurality of print modes including a text print mode suitable for printing text documents;

a main scan driver configured to move one of the print head and the print medium in order to perform main scan; and a print signal generator configured to process a binary dot data representing a dot recording state in each pixel of resolution L in the main scan direction if the selected print mode is text mode, to thereby generate a print signal for pixels of resolution L/R in the main scan direction, R being an integer of at least 2, wherein the mask pattern selector is configured to select one type of mask pattern from a plurality of types of mask patterns corresponding to at least some of dot types among $2^R$ dot types, the $2^R$ dot types being recorded with ink drops ejected at different timing on each pixel of resolution L/R, a number of the ink drops being an integer of at most R, $2^R$ denoting the R-th power of 2; and the mask signal generator is configured to generate a masking signal for recording dots on the pixels of resolution L/R in the main scan direction using both the original masking signal data included in the selected mask pattern and the dot type selection data; wherein the print signal generated from the binary dot data represents a dot pattern that is one of at least some of $2^R$ dot types and closest to an exact dot pattern represented by the binary dot data.

5. The printing apparatus in accordance with claim 2 wherein the printing apparatus has a bidirectional printing function for printing during both forward and return passes of main scan; and the plurality of mask patterns are prepared such that mutually reversed original masking signal data are selected for forward and return passes, respectively.

6. The printing apparatus in accordance with claim 2 further comprising:

a main body of the printing apparatus; and a carriage configured to move in the main scan direction, and also to carry the print head, the mask signal generator, and the masking unit;

wherein the printing apparatus transmits the mask pattern selection data and the dot selection data from the main body to the carriage in parallel.

7. A printing method of selectively forming any of N types of dots which are different in at least one of an ink amount and a dot-formed position in a pixel area on a print medium, N being an integer of at least 2, comprising the steps of:

(a) providing a print head having a plurality of nozzles and a plurality of ejection drive elements for ejecting ink drops from corresponding plurality of nozzles; and (b) generating drive signals for driving the ejection drive elements to form one of the N types of dots in each pixel area in response to print signals, each print signal for one pixel including 2 types of mask selection data, the 2 types of mask selection data being indicative of one type of masking signal among a plurality of types of masking signals corresponding to the N types of dots;

wherein the step (b) comprises the steps of:

(b-1) generating an original drive signal having a plurality of pulses within a main scan period for a single pixel, the original drive signal being commonly applicable to the plurality of ejection drive elements;

(b-2) selecting one type of masking signal from the plurality of type of masking signals in response to the 2 types of mask selection data in order to generate the masking signal; and (b-3) selectively mask the plurality of pulses in the original drive signal using the generated masking signal in order to generate the drive signal to be supplied to the each ejection drive element.

8. The printing method in accordance with claim 7, wherein the 2 types of mask selection data include:

a mask pattern selection data for selecting for each pixel one type of mask pattern from a plurality of types of mask patterns; and a dot type selection data for selecting for each pixel one type of original masking signal data from a plurality of types of original masking signal data included in each of the plurality of types of mask patterns; and the step (b-2) comprises the steps of:

(b-2-1) selecting one type of mask pattern from the plurality of types of mask pattern in response to the mask pattern selection data; and (b-2-2) selecting one type of original masking signal data from the plurality of types of original masking signal data included in the selected mask pattern in response to the dot type selection data, and to generate the masking signal using the selected original masking signal data.

9. The printing method in accordance with claim 8, wherein a number of types of the mask patterns is P, P being an integer of at least 2; and each mask pattern includes Q types of original masking signal data corresponding to Q types of dots, Q being N divided by P.

10. The printing method in accordance with claim 8, further comprising:

(c) allowing a user to select one of a plurality of print modes including a text print mode suitable for printing text documents;

(d) moving one of the print head and the print medium in order to perform main scan; and (e) processing a binary dot data representing a dot recording state in each pixel of resolution L in the main scan direction if the selected print mode is text mode, to thereby generate a print signal for pixels of resolution L/R in the main scan direction, R being an integer of at least 2, wherein the step (b-2-1) includes the step of selecting one type of mask pattern from a plurality of types of mask patterns corresponding to at least some of dot types among $2^R$ dot types, the $2^R$ dot types being recorded with ink drops ejected at different timing on each pixel of resolution L/R, a number of the ink drops being an integer of at most R, $2^R$ denoting the R-th power of 2; and the step (b-2-2) includes the step of generating a masking signal for recording dots on the pixels of resolution L/R in the main scan direction using both the original masking signal data included in the selected mask pattern and the dot type selection data; wherein the print signal generated from the binary dot data represents a dot pattern that is one of at least some of $2^R$ dot types and closest to an exact dot pattern represented by the binary dot data.

11. The printing method in accordance with claim 8, further comprising the steps of:

preparing a plurality of mask patterns such that mutually reversed original masking signal data are selected for forward and return passes, respectively; and printing during both forward and return passes of main scan using the mutually reversed original masking signal data.

12. The printing method in accordance with claim 8, further comprising the steps of:

providing a main body of the printing apparatus and a carriage configured to move in a main scan direction, and also to carry the print head, the masking signal generator, and the masking unit and;

transmitting data for the mask pattern selection and data for the original masking signal selection from the main body to the carriage in parallel.

13. A computer program product for causing a computer to control a printing apparatus for selectively forming any of N types of dots which are different in at least one of an ink amount and a dot-formed position in a pixel area on a print medium, N being an integer of at least 2, the printing apparatus comprising a print head having a plurality of nozzles and a plurality of ejection drive elements for ejecting ink drops from corresponding plurality of nozzles, the computer program product comprising:

a computer readable medium; and a computer program stored on the computer readable medium, the computer program comprising a first program for causing the computer to generate drive signals for driving the ejection drive elements to form one of the N types of dots in each pixel area in response to print signals, each print signal for one pixel including 2 types of mask selection data, the 2 types of mask selection data being indicative of one type of masking signal among a plurality of types of masking signals corresponding to the N types of dots;

wherein the first program comprises:

a second program for causing the computer to generate an original drive signal having a plurality of pulses within a main scan period for a single pixel, the original drive signal being commonly applicable to the plurality of ejection drive elements;

a third program for causing the computer to select one type of masking signal from the plurality of type of masking signals in response to the 2 types of mask selection data in order to generate the masking signal; and a fourth program for causing the computer to selectively mask the plurality of pulses in the original drive signal using the generated masking signal in order to generate the drive signal to be supplied to the each ejection drive element.

14. The computer program product in accordance with claim 13, wherein the 2 types of mask selection data include:

a mask pattern selection data for selecting for each pixel one type of mask pattern from a plurality of types of mask patterns; and a dot type selection data for selecting for each pixel one type of original masking signal data from a plurality of types of original masking signal data included in each of the plurality of types of mask patterns; and the third program comprises:

a fifth program for causing the computer to select one type of mask pattern from the plurality of types of mask pattern in response to the mask pattern selection data; and a sixth program for causing the computer to select one type of original masking signal data from the plurality of types of original masking signal data included in the selected mask pattern in response to the dot type selection data, and to generate the masking signal using the selected original masking signal data.

15. The computer program product in accordance with claim 14, wherein a number of types of the mask patterns is P, P being an integer of at least 2; and each mask pattern includes Q types of original masking signal data corresponding to Q types of dots, Q being N divided by P.

16. The computer program product in accordance with claim 14, further comprising:

a program for causing the computer to allow a user to select one of a plurality of print modes including a text print mode suitable for printing text documents;

a program for causing the computer to move one of the print head and the print medium in order to perform main scan; and a program for causing the computer to process a binary dot data representing a dot recording state in each pixel of resolution L in the main scan direction if the selected print mode is text mode, to thereby generate a print signal for pixels of resolution L/R in the main scan direction, R being an integer of at least 2, wherein a fifth program includes a program for causing the computer to select one type of mask pattern from a plurality of types of mask patterns corresponding to at least some of dot types among $2^R$ dot types, the $2^R$ dot types being recorded with ink drops ejected at different timing on each pixel of resolution L/R, a number of the ink drops being an integer of at most R, $2^R$ denoting the R-th power of 2; and a sixth program includes a program for causing the computer to generate a masking signal for recording dots on the pixels of resolution L/R in the main scan direction using both the original masking signal data included in the selected mask pattern and the dot type selection data; wherein the print signal generated from the binary dot data represents a dot pattern that is one of at least some of $2^R$ dot types and closest to an exact dot pattern represented by the binary dot data.

17. The computer program product in accordance with claim 14 further comprising the programs of:

a program for causing the computer to prepare a plurality of mask patterns such that mutually reversed original masking signal data are selected for forward and return passes, respectively; and a program for causing the computer to print during both forward and return passes of main scan using the mutually reversed original masking signal data.

18. The printing method in accordance with claim 14, further comprising the programs of:

a program for causing the computer to move a carriage carrying the print head, the mask signal generator, and the masking unit in the main scan direction; and a program for causing the computer to transmit the mask pattern selection data and the dot selection data from a main body of the printing apparatus to the carriage in parallel.

* * * * *